US009666966B2

(12) United States Patent
Leibold et al.

(10) Patent No.: US 9,666,966 B2
(45) Date of Patent: May 30, 2017

(54) ELECTRICAL CONNECTOR HAVING ELECTRICAL CONTACTS THAT ENGAGE MATING CONTACTS

(71) Applicant: Tyco Electronics Corporation, Berwyn, PA (US)

(72) Inventors: Kevin Ray Leibold, New Cumberland, PA (US); Justin Shane McClellan, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/321,453

(22) Filed: Jul. 1, 2014

(65) Prior Publication Data

US 2016/0006192 A1 Jan. 7, 2016

(51) Int. Cl.

| | |
|---|---|
| ***H01R 13/04*** | (2006.01) |
| ***H01R 13/05*** | (2006.01) |
| ***H01R 12/72*** | (2011.01) |
| ***H01R 13/11*** | (2006.01) |
| *H01R 12/58* | (2011.01) |
| *H01R 13/6585* | (2011.01) |

(52) U.S. Cl.
CPC ..... *H01R 12/724* (2013.01); *H01R 12/727* (2013.01); *H01R 13/04* (2013.01); *H01R 13/113* (2013.01); *H01R 12/585* (2013.01); *H01R 13/6585* (2013.01)

(58) Field of Classification Search
CPC ..... H01R 13/04; H01R 13/05; H01R 13/055; H01R 13/057
USPC ..... 439/884, 886
See application file for complete search history.

(56) References Cited

U.S. PATENT DOCUMENTS

| | | | | |
|---|---|---|---|---|
| 4,778,231 | A * | 10/1988 | Seidler | H01R 13/193 439/295 |
| 5,135,414 | A * | 8/1992 | van Dijk | H01R 13/04 439/660 |
| 5,174,777 | A * | 12/1992 | Carter | 439/290 |
| 5,775,963 | A * | 7/1998 | Byfield, Jr. | H01R 13/04 439/884 |
| 6,755,699 | B2 * | 6/2004 | Beers | H01R 13/193 439/884 |
| 2006/0205290 | A1 * | 9/2006 | Narita | H01R 13/2464 439/884 |
| 2012/0178317 | A1 * | 7/2012 | Skidmore | 439/884 |

* cited by examiner

*Primary Examiner* — Renee Luebke
*Assistant Examiner* — Paul Baillargeon

(57) ABSTRACT

Electrical connector including a contact array having electrical contacts. Each of the electrical contacts includes a proximal base and an elongated body that extends from the proximal base to a distal end. The elongated body has a longitudinal axis extending between the proximal base and the distal end, and a lateral axis that is perpendicular to the longitudinal axis. The elongated body includes a body side that extends along the longitudinal and lateral axes and is shaped to form a wipe track. The wipe track is configured to engage a contact finger of the mating connector as the contact finger moves linearly along the longitudinal axis. The wipe track has a non-linear path such that the wipe track turns at least partially in a lateral direction as the wipe track moves toward the proximal base along the longitudinal axis.

13 Claims, 8 Drawing Sheets

ELECTRICAL CONNECTOR HAVING ELECTRICAL CONTACTS THAT ENGAGE MATING CONTACTS

BACKGROUND OF THE INVENTION

The subject matter herein relates generally to electrical connectors having electrical contacts that engage corresponding mating contacts during a mating operation with another electrical connector.

Electrical connectors are used to transmit data and/or power in various industries. The electrical connectors are often configured to repeatedly engage and disengage complementary electrical connectors. The process of mating the electrical connectors may be referred to as a mating operation. Each mating operation may cause a small amount of wear to the electrical connectors. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts mechanically engage and slide along the corresponding header contacts. The sliding engagement between the receptacle and header contacts may be referred to as wiping, because each receptacle contact wipes along an exterior surface of the corresponding header contact. At this time, adhesion between the receptacle contact and the corresponding header contact may remove surface materials from the corresponding header contact as the receptacle contact wipes the header contact.

In many cases, the header contacts are disposed within a connector cavity of the header connector that is sized and shaped to receive the receptacle connector. The connector cavity opens to an exterior of the header connector thereby exposing the header contacts to an ambient environment. Certain environmental conditions in the ambient environment, such as humidity, may increase the likelihood of corrosion developing on the exterior surfaces of the header contacts. The portions of the header contacts that are closest to the cavity opening are more exposed to the ambient environment and may be at greater risk for developing corrosion.

Corrosion can negatively affect performance of an electrical connector. For example, each of the receptacle contacts is configured to engage the corresponding header contact at a final contact area when the receptacle and header connectors are fully mated and in operation. However, as the receptacle contact wipes the header contact during the mating operation, the receptacle contact may push or plow the corrosive matter toward the final contact area. Corrosive matter at the final contact area may cause an unstable electrical connection between the receptacle contact and the header contact, which can negatively affect signal transmission through the mated connectors.

Accordingly, a need remains for electrical contacts and electrical connectors that reduce an amount of corrosive matter at the final contact area.

BRIEF DESCRIPTION OF THE INVENTION

In an embodiment, an electrical connector is provided that includes a connector housing configured to engage a mating connector during a mating operation. The electrical connector also includes a contact array having electrical contacts that are coupled to the connector housing. Each of the electrical contacts includes a proximal base coupled to the connector housing and an elongated body that extends from the proximal base to a distal end. The elongated body has a longitudinal axis extending between the proximal base and the distal end, and a lateral axis that is perpendicular to the longitudinal axis. The elongated body includes a body side that extends along the longitudinal and lateral axes and is shaped to form a wipe track. The wipe track is configured to engage a contact finger of the mating connector as the contact finger moves linearly along the longitudinal axis. The wipe track has a non-linear path such that the wipe track turns at least partially in a lateral direction as the wipe track moves toward the proximal base along the longitudinal axis.

In an embodiment, an electrical connector is provided that includes a connector housing configured to engage a mating connector during a mating operation. The electrical connector includes a contact array having electrical contacts coupled to the connector housing. Each of the electrical contacts includes an elongated body having a distal end and a proximal base. The elongated body is oriented with respect to a longitudinal axis that extends between the distal end and the proximal base and a lateral axis that is perpendicular to the longitudinal axis. The elongated body also has a body side extending along the longitudinal axis that is shaped to form a wipe track. The wipe track is configured to directly engage a contact finger of the mating connector that is moving substantially parallel to the longitudinal axis along a mating direction. The elongated body has a body width that extends along the lateral axis, and the wipe track has a track width that extends along the lateral axis. The track width is less than the body width for a majority of the wipe track. The wipe track has a path in which at least a portion of the path is non-parallel with respect to the longitudinal axis.

In an embodiment, an electrical contact is provided that includes a proximal base and an elongated body that extends from the proximal base to a distal end. The elongated body has a longitudinal axis extending between the proximal base and the distal end, and a lateral axis that is perpendicular to the longitudinal axis. The elongated body includes a body side that extends along the longitudinal and lateral axes and is shaped to form a wipe track. The wipe track is configured to engage a contact finger of a mating connector as the contact finger moves linearly along the longitudinal axis. The wipe track has a non-linear path such that the wipe track turns at least partially in a lateral direction as the wipe track moves toward the proximal base along the longitudinal axis.

DETAILED DESCRIPTION OF THE INVENTION

Embodiments set forth herein may include electrical contacts, electrical connectors having the electrical contacts, and communication systems having the electrical connectors. Embodiments may be configured to reduce an accumulation of corrosive matter at a contact zone and/or improve electrical performance compared other known contacts, connectors, or systems. Embodiments may also reduce wear of the electrical contacts. Although the illustrated embodiment includes electrical connectors that are used in high-speed communication systems, such as backplane or midplane communication systems, it should be understood that embodiments may be used in other communication systems or in other systems/devices that utilize electrical connectors. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, or mating contacts. When similar elements are labeled differently (e.g., receptacle contacts and mating contacts), the different labels do not necessarily require structural differences. For instance, in some embodiments, the receptacle contacts described herein may be referred to as mating contacts.

Figure 1:
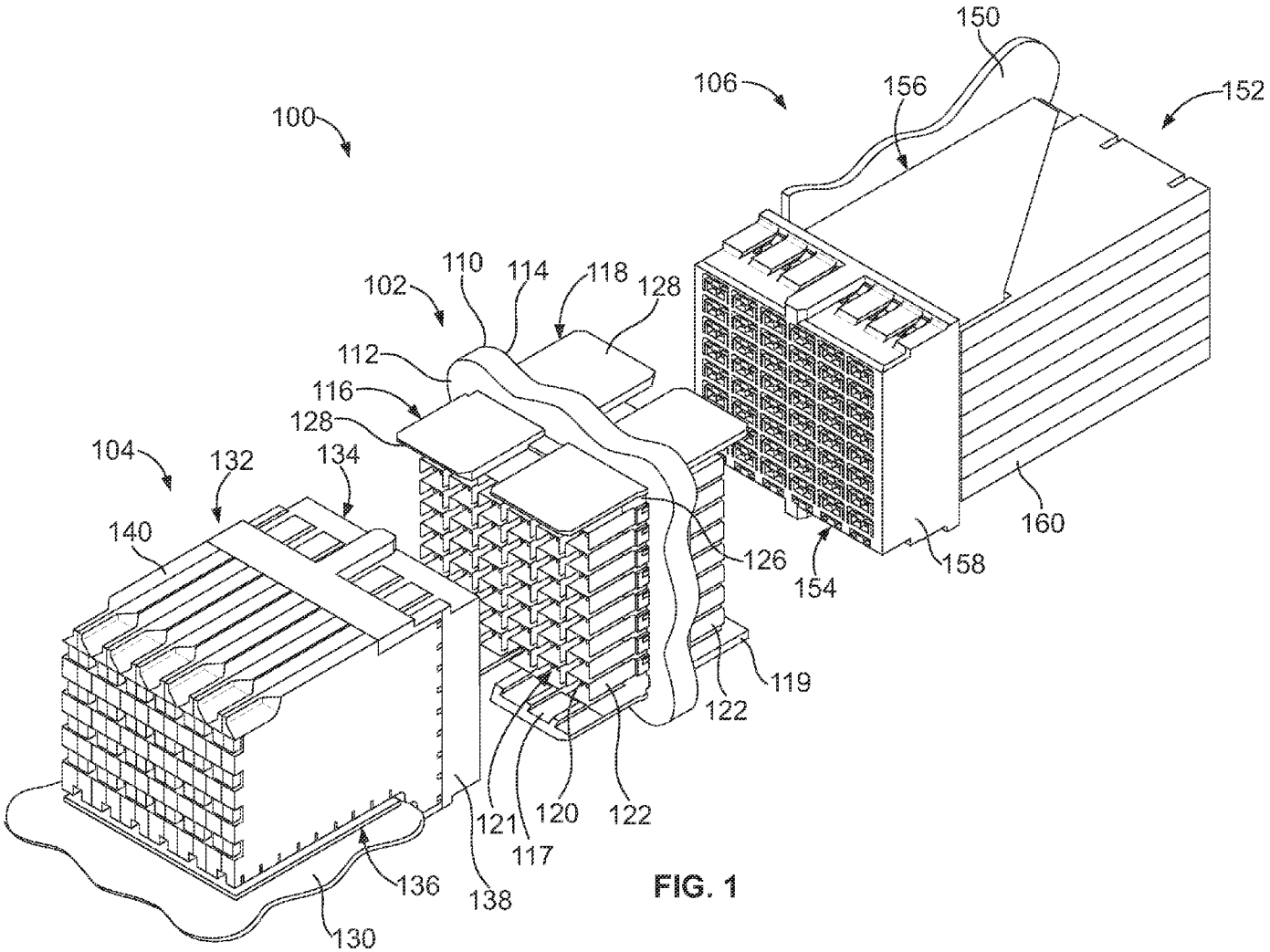
FIG. 1 is a front perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
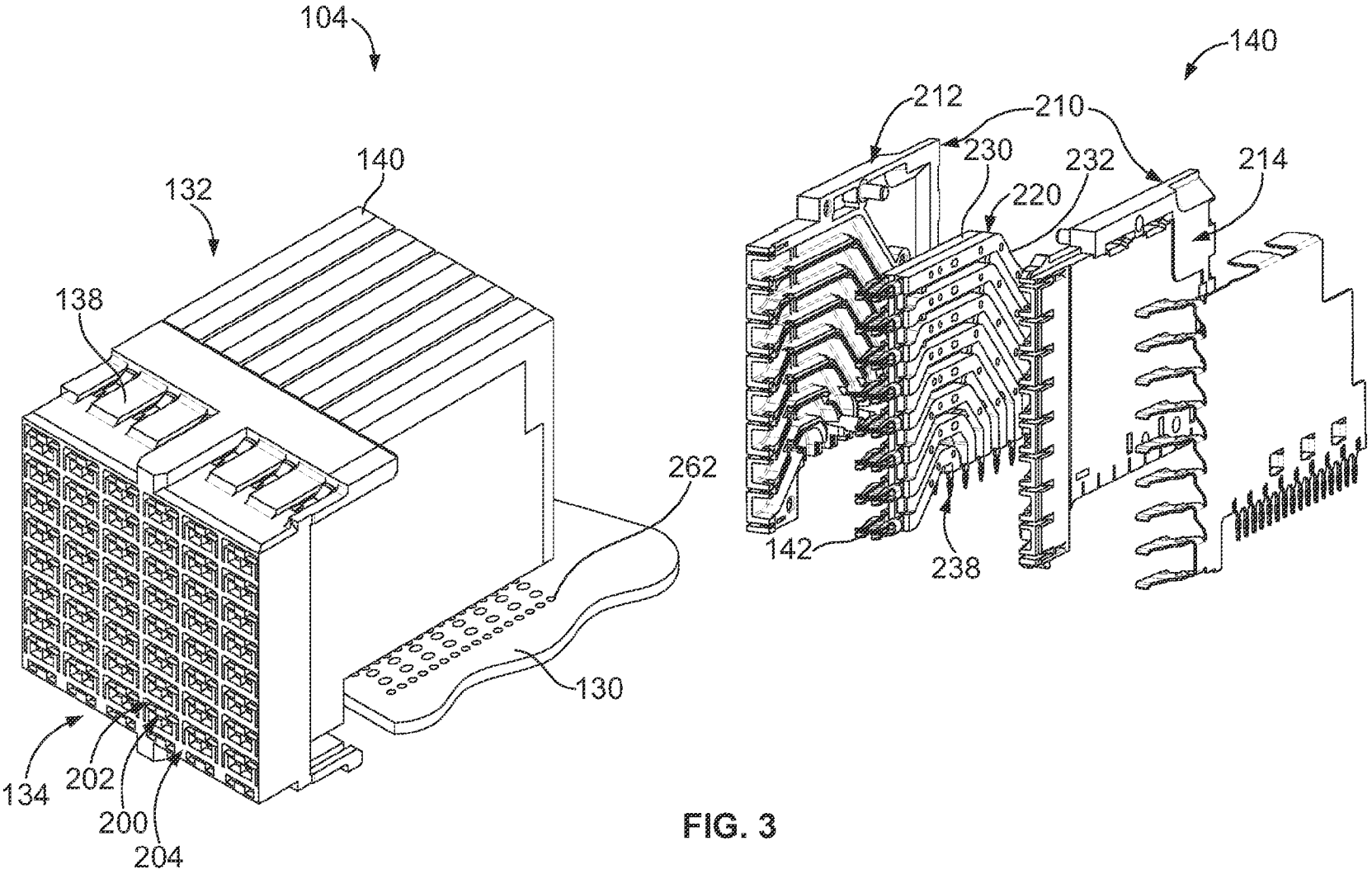
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Although not shown, in some embodiments, the communication system 100 may include a loading mechanism. The loading mechanism may include, for example, latches or levers that fully mate the corresponding receptacle and header connectors. For instance, the loading mechanism may be operably coupled to the receptacle connector 132 and, when actuated, drive the receptacle connector 132 into the header connector 116 to assure that the receptacle and header connectors 132, 116 are fully mated.

Figure 2:
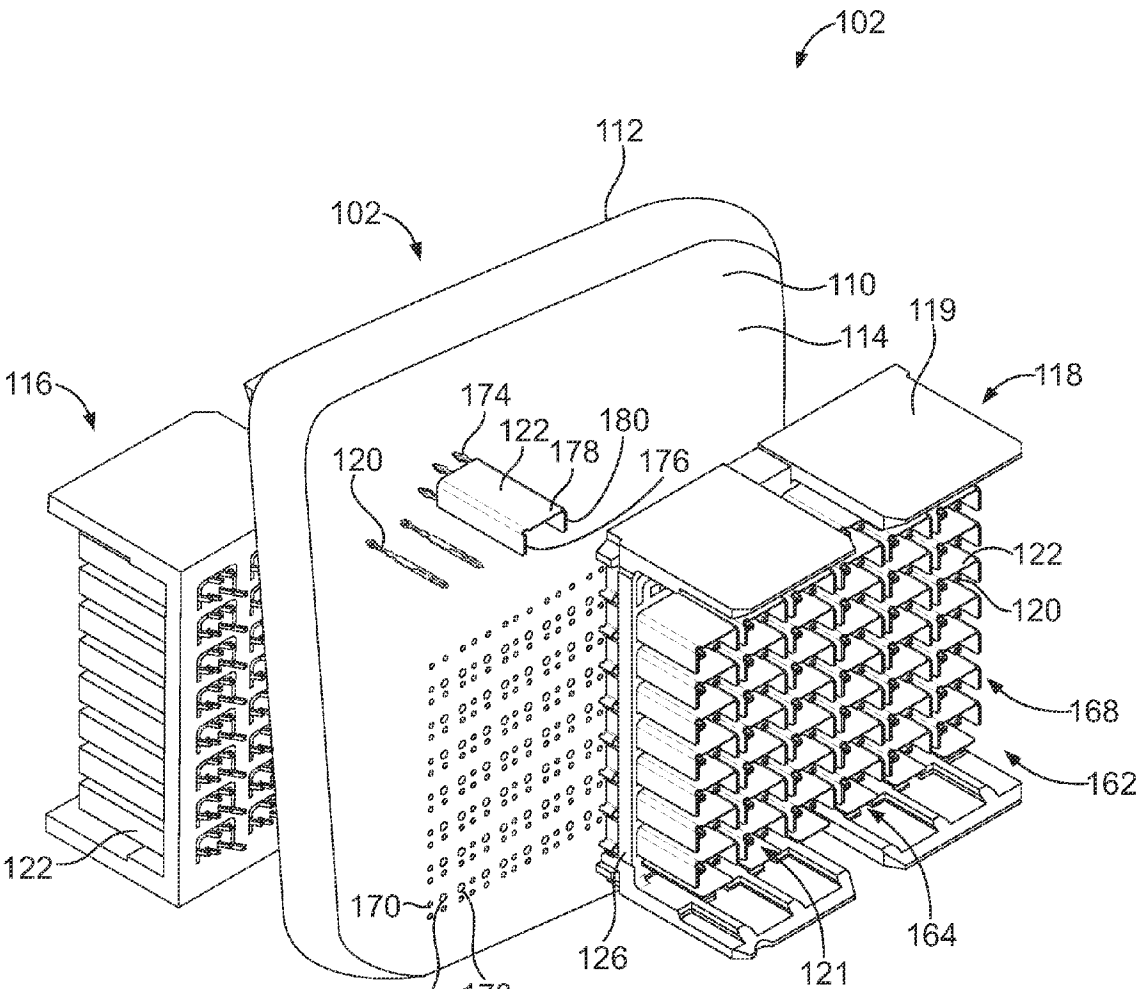
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a front end 162 that faces away from the second board side 114 of the circuit board 110. The connector housing 119 defines a housing cavity 164 that opens to the front end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a front end 204 of the front housing 138. The front end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 may be configured to receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 a second holder member 214 that are coupled together. The holder members 214, 214 may be fabricated from a conductive material. As such, the holder members 214, 214 may provide electrical shielding for the first receptacle connector 132. When the holder members 214, 214 are coupled together, the holder members 214, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through the signal conductor (not shown).

Figure 4:
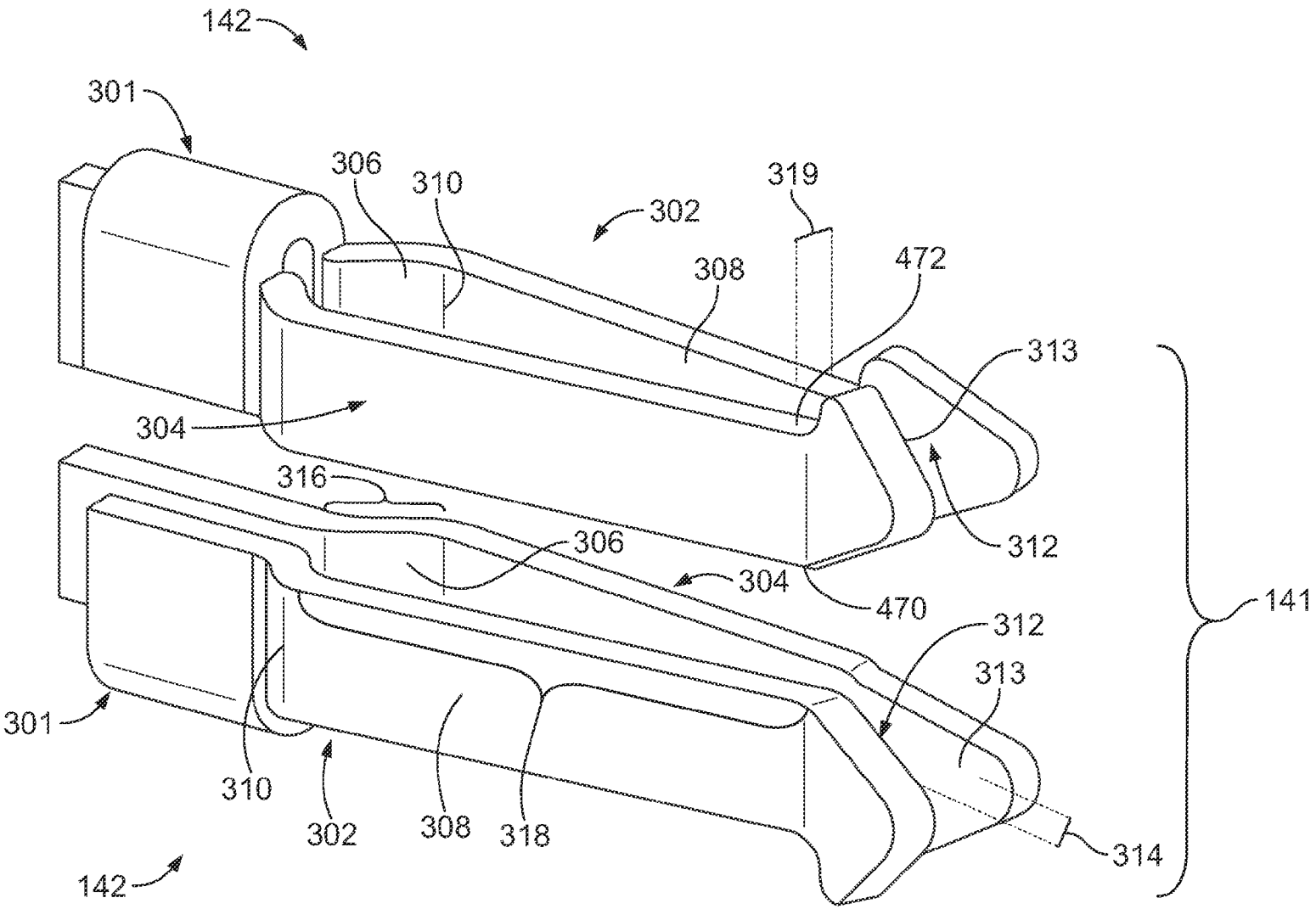
FIG. 4 is an isolated view of receptacle contacts that may be used with the receptacle connector of FIG. 3.

FIG. 4 is an isolated perspective view of a signal pair 141 of two receptacle contacts 142. Each of the receptacle contacts 142 of the signal pair 141 is configured to mechanically and electrical engage a corresponding header contact 120 (FIG. 1) of the same signal pair 121 (FIG. 1). Each of the receptacle contacts 142 may be stamped from a common sheet of material and be shaped to include a contact base 301 and a pair of elongated, flexible contact fingers 302, 304 that project from the corresponding contact base 301.

In the illustrated embodiment, the receptacle contacts 142 are identical. As such, the following description is applicable to each of the receptacle contacts 142. It should be understood, however, that the receptacle contacts 142 of the signal pair 141 are not required to be identical. It should also be understood that the receptacle contacts 142 of the corresponding receptacle connector are not required to be identical. For example, in some embodiments, the receptacle contacts may be configured differently so that the receptacle contacts electrically engage the corresponding header contacts at different times during the mating operation.

Each of the contact fingers 302, 304 includes a base portion 306, a beam portion 308, and a joint portion 310. The beam portions 308 extend to respective mating interfaces 312, which are defined between opposite edge portions 470, 472. The mating interfaces 312 of the contact fingers 302, 304 face each other with a contact-receiving gap 314 therebetween. In the illustrated embodiment, the corresponding mating interfaces 312 of the contact fingers 302, 304 are substantially paddle-shaped or tab-shaped. The mating interface 312 includes a flared portion 313 that extends away from the opposing mating interface 312 to enlarge the contact-receiving gap 314. The curved contour of the mating interfaces 312 and the flared portions 313 may facilitate receiving one of the header contacts 120 (FIG. 1) within the contact-receiving gap 314.

In FIG. 4, the contact fingers 302, 304 are in a relaxed condition or state. During a mating operation between, for example, the first header connector 116 (FIG. 1) and the first receptacle connector 132 (FIG. 1), each of the header contacts 120 (FIG. 1) is received within a contact-receiving gap 314 of a corresponding receptacle contact 142. The opposing mating interfaces 312 may engage opposite body sides of the header contact 120.

When the contact fingers 302, 304 are in deflected conditions, each of the contact fingers 302, 304 may generate a normal force that presses the corresponding mating interface 312 against the corresponding header contact 120 in a direction toward the other mating interface 312. As such, the contact fingers 302, 304 may pinch the corresponding header contact 120 therebetween. To this end, each of the contact fingers 302, 304 may be configured to provide a designated normal force when the corresponding contact finger is in a deflected condition. For example, the base portion 306 may have a designated length 316, the beam portion 308 may have a designated length 318, and the joint portion 310 may have a designated shape or contour. Each of the contact fingers 302, 304 may also have a designated thickness 319. In an exemplary embodiment, the thickness 319 is substantially uniform throughout the corresponding contact finger. The lengths 316, 318, the shape of the joint portion 310, and the thickness 319 may be configured such that each of the contact fingers 302, 304 provides a designated normal force against the header contact 120. The lengths 316, 318 and the shape of the joint portion 310 may also be configured to locate the mating interface 312 at a designated location along the header contact 120 (FIG. 1).

Figure 5:
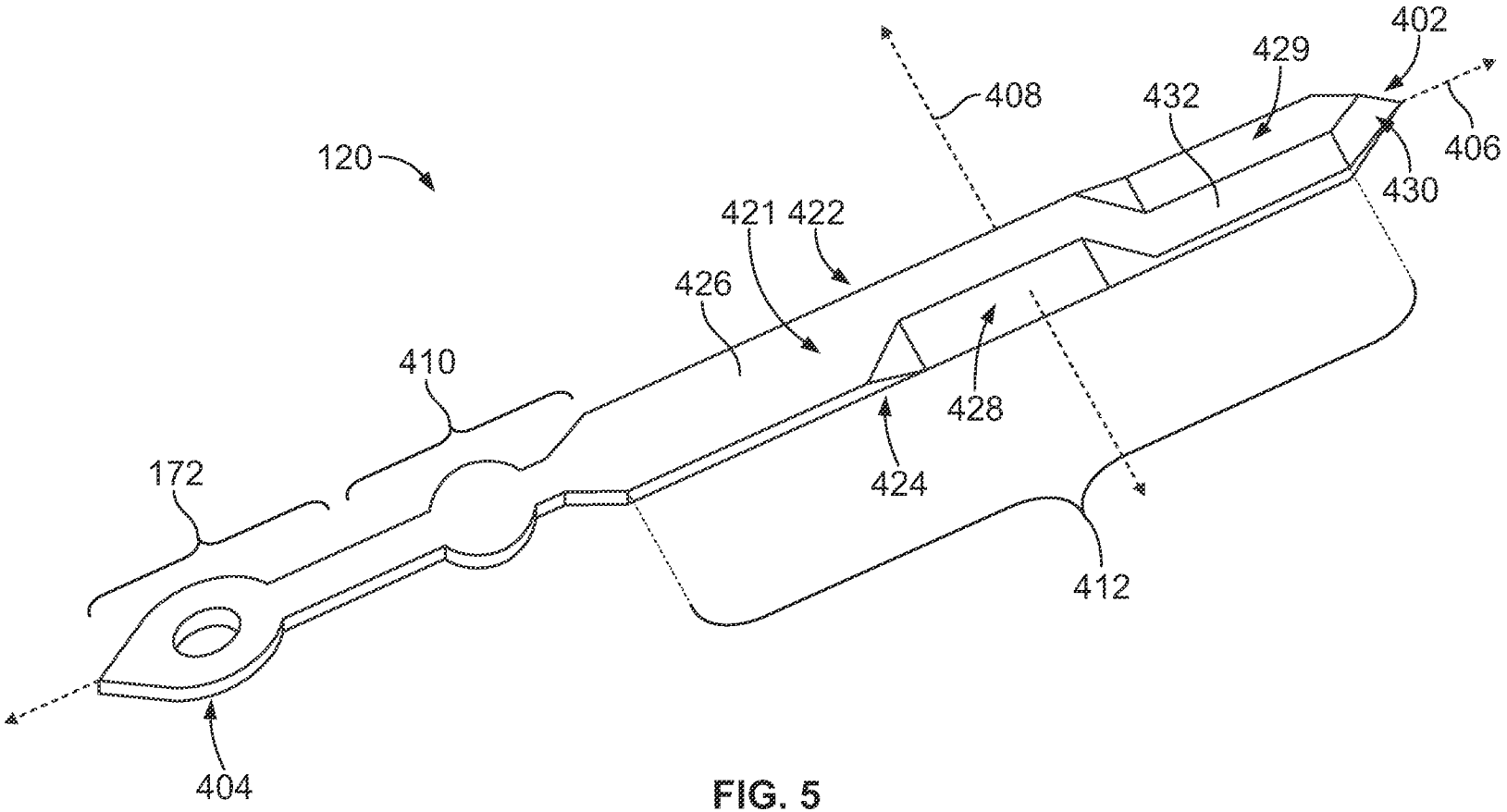
FIG. 5 is an isolated view of a header contact that may be used with the header connector of FIG. 2.

FIG. 5 is an isolated view of an exemplary header contact 120. The header contact 120 includes a distal end or tip 402 and a board end or tail 404. The board end 404 is configured to engage the circuit board 110 (FIG. 1). The distal end 402 may represent the portion of the header contact 120 that is located furthest from the circuit board 110 or the mounting wall 126 (FIG. 1) and is first to engage or interface with another electrical connector, such as the second receptacle connector 152 (FIG. 1). As shown, the header contact 120 has a longitudinal axis 406 extending therethrough between the board end 404 and the distal end 402. For reference, the longitudinal axis 406 extends through an approximate center of the header contact 120. The header contact 120 is also oriented with respect to a lateral axis 408. The lateral axis 408 is perpendicular to the longitudinal axis 406.

As shown in FIG. 5, the header contact 120 includes the compliant pin 172 and a proximal base 410. The header contact 120 also includes an elongated body 412 that extends from the proximal base 410 toward the distal end 402. The compliant pin 172 includes the board end 404, and the elongated body 412 includes the distal end 402. As described above, the compliant pin 172 mechanically engages and electrically couples to a corresponding conductive via 170 (FIG. 2) of the circuit board 110 (FIG. 1). The proximal base 410 is sized and shaped to directly engage the mounting wall 126 (FIG. 1). For example, the proximal base 410 may be inserted into a passage (not shown) that extends through the mounting wall 126 and engage the mounting wall 126 to form an interference fit therewith. The elongated body 412 may represent the portion of the header contact 120 that is exposed within the housing cavity 164 (FIG. 2).

In the illustrated embodiment, the header contact 120 has a linear structure from the board end 404 to the distal end 402. In other embodiments, the header contact 120 may not be linear from the board end 404 to the distal end 402. For example, the elongated body 412 may be linear and extend along the longitudinal axis between the distal end 402 and the proximal base 410 as shown in FIG. 5, but the proximal base 410 may be shaped to reposition the compliant pin 172 such that the compliant pin 172 is not co-linear with the elongated body 412. In such embodiments, the proximal base 410 may be shaped to facilitate engaging the mounting wall 126 and/or positioning the compliant pin 172 at a designated location.

The elongated body 412 includes body sides 421, 422, 424 and a body side 423 (shown in FIGS. 7 and 8) that extend generally along the longitudinal axis 406 between the proximal base 410 and the distal end 402. The body sides 421-424 may be exposed within the housing cavity 164 (FIG. 1). The body sides 422, 424 face in generally opposite directions, and the body sides 421, 423 face in generally opposite directions. Also shown, the body side 421 includes a planar surface 426 and a plurality of recessed portions 428, 429, 430. The planar surface 426 generally coincides with a contact plane 464 (shown in FIGS. 7 and 8) that extends substantially parallel to the longitudinal and lateral axes 406, 408. The recessed portions 428, 429, 430 do not coincide with the contact plane 464. As described in greater detail below, the body side 421 is shaped to form a wipe track 432 that is configured to directly engage the mating interface 312 (FIG. 4) of a corresponding contact finger. The body side 423 may include a wipe track 434 (shown in FIGS. 7 and 8) that is similar to the wipe track 432. In an exemplary embodiment, the body sides 421, 423 and the respective wipe tracks 432, 434 have identical configurations. For example, if the header contact 120 were rotated 180° about the longitudinal axis 406, the elongated body 412 would have the same appearance as shown in FIG. 5. The elongated body 412, however, is not required to have an identical configuration along the body sides 421, 423 and may have different configurations in other embodiments.

Figure 6:
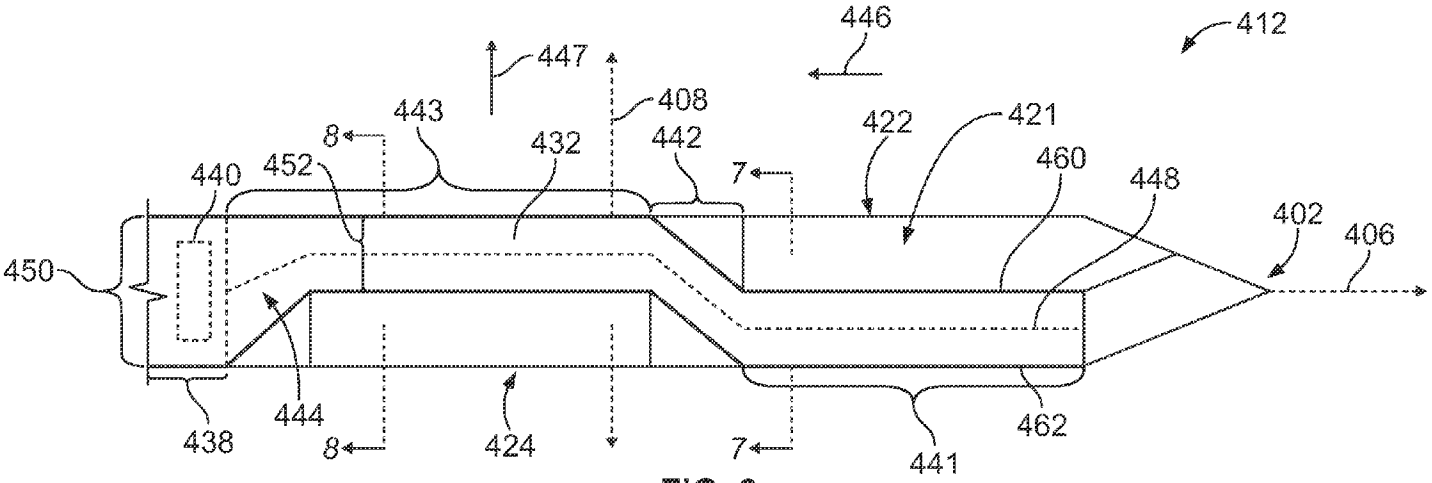
FIG. 6 is a plan view of a portion of the header contact that may be used with the header connector of FIG. 2.
Figure 7:
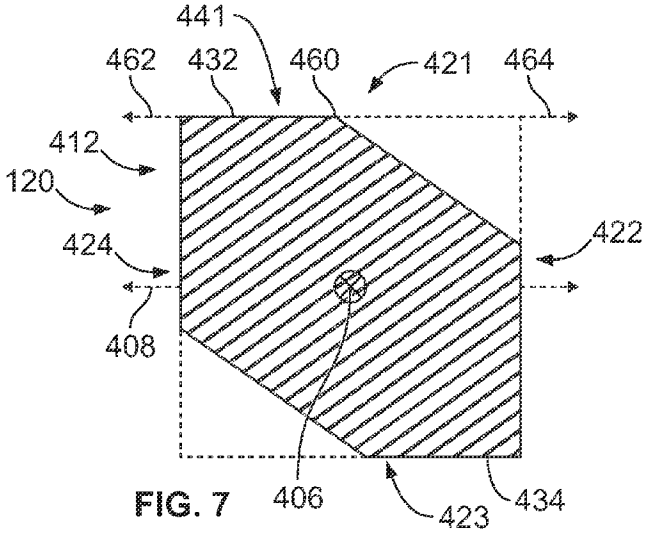
FIG. 7 is a cross-section of the header contact taken along the line 7-7 in FIG. 6.

FIG. 6 is a plan view of the body side 421 illustrating the wipe track 432 in greater detail. Although the following description is with reference to the wipe track 432, the description may also be applicable to the wipe track 434 (FIG. 7). The elongated body 412 extends from the proximal base 410 (FIG. 5) to the distal end 402 along the longitudinal axis 406. The wipe track 432 is configured to reduce an amount of corrosive matter that may accumulate within a contact zone 438. The contact zone 438 represents an area along the body side 421 that is configured to engage the mating interface 312 (FIG. 4) of the corresponding contact finger after the corresponding receptacle and header connectors are fully mated and operable.

In the illustrated embodiment, the wipe track 432 includes, sequentially, a first track segment 441, a second track segment 442, and a third track segment 443. The third track segment 443 includes an end 444 of the wipe track 432 that is coupled to the contact zone 438. During the mating operation, the mating interface 312 (FIG. 4) of the corresponding contact finger is configured to engage the wipe track 432 proximate to the distal end 402 and slide along, sequentially, the first track segment 441, the second track segment 442, and the third track segment 443. The mating interface 312 may then slide from the end 444 of the wipe track 432 to the contact zone 438. During the mating operation, the mating interface 312 moves linearly in a mating direction 446 that is substantially parallel to the longitudinal axis 406.

During the mating operation, the mating interface 312 moves in a generally linear manner along the longitudinal axis 406. On the other hand, a path 448 of the wipe track 432 is non-linear such that the wipe track 432 turns at least partially in a lateral direction 447 as the wipe track 432 moves toward the proximal base 410 (FIG. 5) along the longitudinal axis 406. For example, the first and third track segments 441, 443 extend parallel to the longitudinal axis 406. The second track segment 442, however, extends at least partially along the lateral axis 408 (or at least partially in the lateral direction 447) between the first and third track segments 441, 443. As such, the wipe track 432 moves in multiple directions along the body side 421. In the illustrated embodiment, the wipe track 432 includes only one turn at the second track segment 442. In other embodiments, the wipe track 432 may include multiple turns. For example, in other embodiments, the wipe track 432 may also move in a lateral direction that is opposite the lateral direction 447.

The elongated body 412 has a body width 450 and the wipe track 432 has a track width 452. Each of the body width 450 and the track width 452 may be measured along the lateral axis 408. In some embodiments, the track width 452 for at least a portion of the wipe track 432 may be less than the body width 450 of the elongated body 412. For example, in the illustrated embodiment, a majority of the wipe track 432 has a track width 452 that is less than the body width 450. More particularly, the track width 452 for at least a portion of the wipe track 432 may be less than the body width 450 at the contact zone 438. As specific examples, the track width 452 may be less than the body width 450 for at least 60% of the wipe track 432, for at least 70% of the wipe track 432, or for at least 80% of the wipe track 432. In particular embodiments, the track width 452 may be less than the body width 450 for the entire or nearly the entire wipe track 432.

Also shown, the track width 452 is substantially common or uniform along the first track segment 441, the second track segment 442, and a majority of the third track segment 443. As shown, the track width 452 at the end 444 of the wipe track 432 increases to be substantially equal to the body width 450 at the contact zone 438. Accordingly, the track width 452 is less than the body width 450 throughout the wipe track 432 in the illustrated embodiment. In other embodiments, however, the track width 452 may be equal to the body width 450 for one or more portions of the wipe track 432. For example, in an alternative embodiment, the track width 452 along the second track segment 442 may be substantially equal to the body width 450.

As shown in FIG. 6, the mating interface 312 may directly engage the contact zone 438 at a final contact area 440. It should be understood, however, that the final contact area 440 represents one area where the mating interface 312 may be positioned during operation. Due to tolerances in manufacturing and assembly, the final contact area 440 may be closer to the wipe track 432, further from the wipe track 432, or closer to either one of the body sides 422, 424. In some embodiments, the final contact area 440 may be located at the end of the wipe track 432.

In some embodiments, the path 448 of the wipe track 432 may be represented by a center line that extends between the two track edges 460, 462 of the wipe track 432. The center line may be defined by as a series of points that are located halfway between the track edges 460, 462. As shown in FIG. 6, the path 448 is non-parallel with respect to the longitudinal axis 406 through the second track segment 442. Along the second track segment 442, the path 448 extends partially in the lateral direction 447 and partially in the mating direction 446. The path 448 extends from being proximate to the body side 424 to being proximate to the body side 422.

In an exemplary embodiment, the header contact 120 is stamped from sheet metal having opposite side surfaces with a thickness extending therebetween. When the header contact 120 is stamped, the body sides 421, 423 may be formed from the opposite side surfaces of the sheet metal, and the body sides 422, 424 may be stamped edges. The stamping process may provide the recessed portions 428-430 and thereby form the wipe track 432. The elongated body 412 may have a substantially uniform thickness that is measured between the first and second body sides 421, 423 and a width that is measured between the body sides 422, 424. In an exemplary embodiment, the thickness and width are substantially equal.

After stamping an unfinished header contact 120 from the sheet metal, the header contact 120 may be treated to include designated coatings. By way of example only, the sheet metal may include a copper alloy. After stamping the header contact 120 from the copper alloy, a first coating (not shown) may be applied directly to the copper alloy base. A second coating (not shown) may be applied onto the first coating.

The first and second coatings may be applied using, for example, an electroplating process. In an exemplary embodiment, the first coating includes nickel or tin and the second coating includes gold. In particular embodiments, the gold is selectively located at the contact zone 438 and not along the wipe track 432. In an exemplary embodiment, the header contact 120 may include a third coating that is configured to prevent moisture from contacting the second coating.

Figure 8:
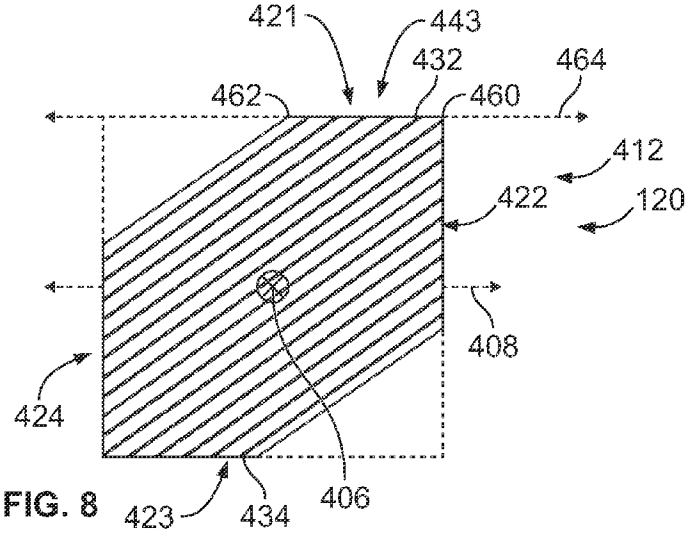
FIG. 8 is another cross-section of the header contact taken along the line 8-8 in FIG. 6.

FIGS. 7 and 8 illustrate cross-sections of the elongated body 412 of the header contact 120 taken along the lines 7-7 and 8-8, respectively, in FIG. 6. The elongated body 412 is oriented with respect to the longitudinal axis 406 and the lateral axis 408. FIGS. 7 and 8 show each of the body sides 421-424 and the wipe tracks 432, 434 that extend along the body sides 421, 423, respectively. Although the following is with respect to the wipe track 432, the description may also be applicable to the wipe track 434.

As shown in FIGS. 7 and 8, the wipe track 432 substantially coincides with the contact plane 464. The contact plane 464 extends parallel to a plane defined by the longitudinal and lateral axes 406, 408. In an exemplary embodiment, the entire wipe track 432 and the contact zone 438 (FIG. 6) coincide with the contact plane 464. In such embodiments, the contact finger that engages the wipe track 432 may have a constant deflection throughout the mating operation and, therefore, provide a constant normal force against the header contact 120. Alternatively, one or more portions of the wipe track 432 may not coincide with the contact plane 464. For example, the first track segment 441 (FIG. 7) may have a different elevation relative to the third track segment 442 (FIG. 8). More specifically, the first track segment 441 may be located closer to the longitudinal axis 406 than the third track segment 443. In such embodiments, the contact finger may have different deflected conditions during the mating operation. Embodiments in which the wipe track 432 has different elevations are described in greater detail in U.S. patent application Ser. No. 14/321,395, which is incorporated by reference in its entirety.

The body side 421 is shaped such that the wipe track 432 has different lateral positions along the lateral axis 408 with respect to the opposite body sides 422, 424. For example, the wipe track 432 extends laterally between the track edges 460, 462 as shown in FIGS. 7 and 8. The cross-section of FIG. 7 includes the first track segment 441. As shown, the track edge 462 couples to the body side 424, and the track edge 460 is located proximate to a midpoint between the body sides 422, 424. The cross-section of FIG. 8 includes the third track segment 443. As shown, the track edge 460 couples to the body side 422, and the track edge 462 is located proximate to a midpoint between the body sides 422, 424.

Figure 9:
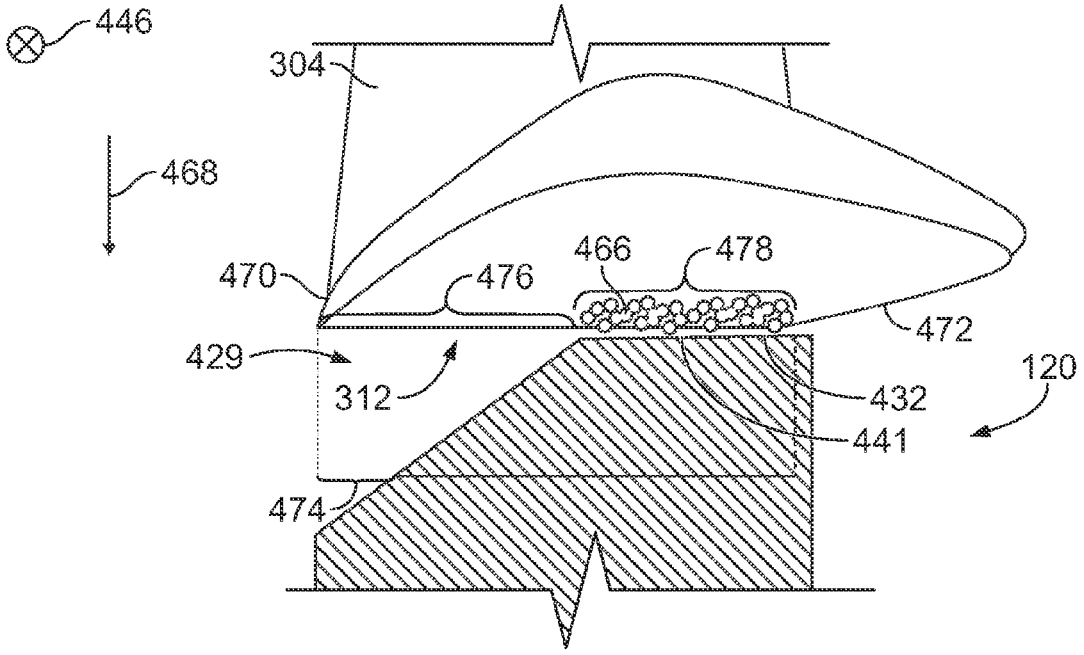
FIG. 9 illustrates the header contact during a first stage of a mating operation with a corresponding receptacle contact.
Figure 10:
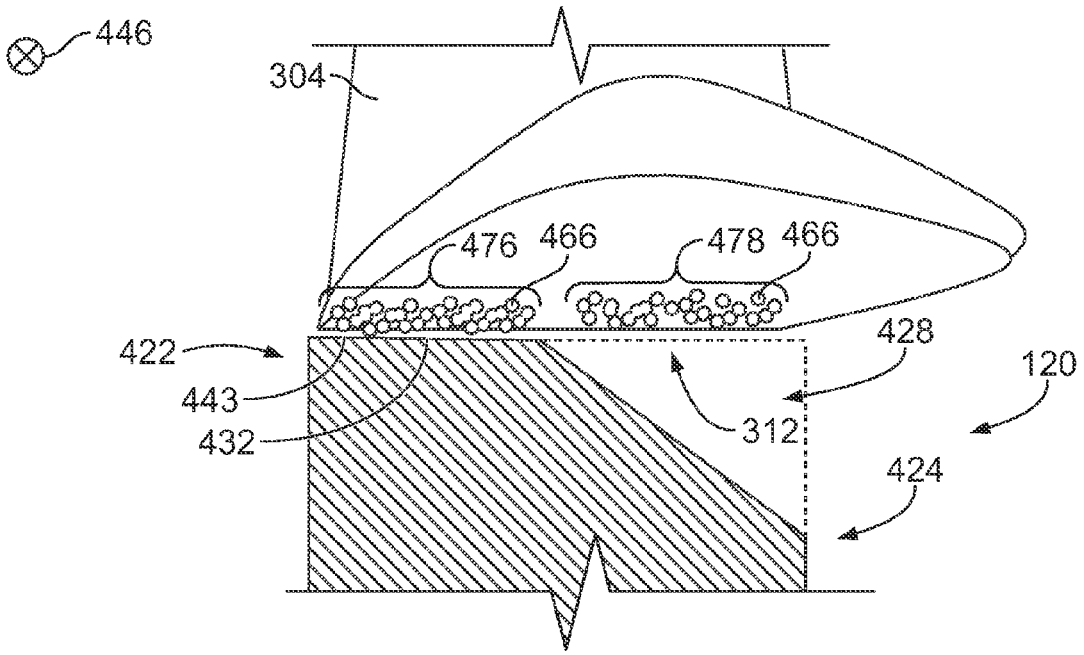
FIG. 10 illustrates the header contact during a later second stage of the mating operation with the corresponding receptacle contact.

FIGS. 9 and 10 illustrate the header contact 120 engaging the contact finger 304 at first and second stages, respectively, of a mating operation. Although FIGS. 7 and 8 illustrate cross-sections of the header contact 120 when viewed in the mating direction 446 (FIG. 6), FIGS. 9 and 10 illustrate views in the opposite direction in order to illustrate a build-up of corrosive matter that may occur during the mating operation. For illustrative purposes, the header contact 120 is represented as a cross-section in FIGS. 9 and 10. The contact finger 304, however, is represented in an end view in FIGS. 9 and 10 to show the build-up of the corrosive matter.

With respect to FIG. 9, the mating interface 312 extends laterally between the opposite edge portions 470, 472 of the contact finger 304. The mating interface 312 has a width 474. The mating interface 312 includes a first contact area 476 and a second contact area 478. The first contact area 476 extends laterally from the edge portion 470 toward the edge portion 472. The second contact area 478 extends laterally from the edge portion 472 toward the edge portion 470. In the illustrated embodiment, each of the first and second contact areas 476, 478 extends about half of the width 474.

As shown in FIG. 9, the contact finger 304 initially engages the first track segment 441 of the wipe track 432 at a first stage of the mating operation. The contact finger 304 is in a deflected condition and has a normal force 468 that presses the mating interface 312 against the wipe track 432. The mating interface 312 is moving in the mating direction 446, which is out of the page. As the contact finger 304 moves in the mating direction 446, the mating interface 312 engages the first track segment 441. More specifically, the second contact area 478 engages the wipe track 432 while the first contact area 476 does not engage the wipe track 432 and, instead, moves over the recessed portion 429. Under some circumstances, corrosive matter 466 may exist along the first track segment 441. As the mating interface 312 wipes along the first track segment 441, adhesion between the mating interface 312 and the wipe track 432 may remove surface particles, including the corrosive matter 466. As the mating interface 312 moves along the wipe track 432, the corrosive matter 466 may accumulate along the second contact area 478.

FIG. 10 shows the mating interface 312 of the contact finger 304 engaging the third track segment 443 of the wipe track 432. As shown, the wipe track 432 has moved from being adjacent to the body side 424 to being adjacent to the body side 422. As the contact finger 304 moves in the mating direction 446, the first contact area 476 of the mating interface 312 engages the third track segment 443. The second contact area 478, however, moves over the recessed portion 428 and does not engage the header contact 120. The third track segment 443 may also include the corrosive matter 466. As shown in FIG. 10, the corrosive matter 466 along the third track segment 443 may accumulate. However, the accumulation of the corrosive matter 466 from the third track segment 443 is located along the first contact area 476. More specifically, the corrosive matter 466 along the third track segment 443 does not add to the corrosive matter 466 from the first track segment 441 (FIG. 6) that accumulated along the second contact area 478. As such, a smaller amount of corrosive matter 466 may accumulate along the entire mating interface 312. Consequently, a smaller amount of corrosive matter 466 may exist between the mating interface 312 and the contact zone 438 (FIG. 6). In some embodiments, the wipe track 432 may reduce wear along the mating interface 312 of the contact finger 304.

Figure 13:
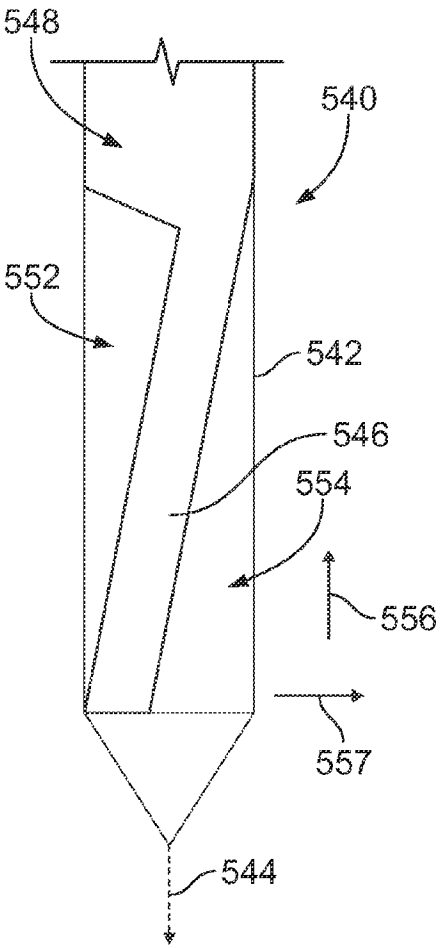
FIG. 13 is a plan view of a portion of a header contact formed in accordance with an embodiment.
Figure 12:
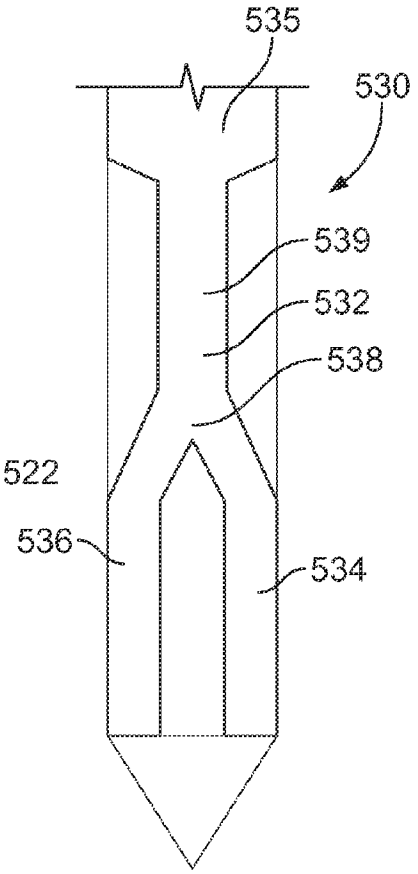
FIG. 12 is a plan view of a portion of a header contact formed in accordance with an embodiment.
Figure 11:
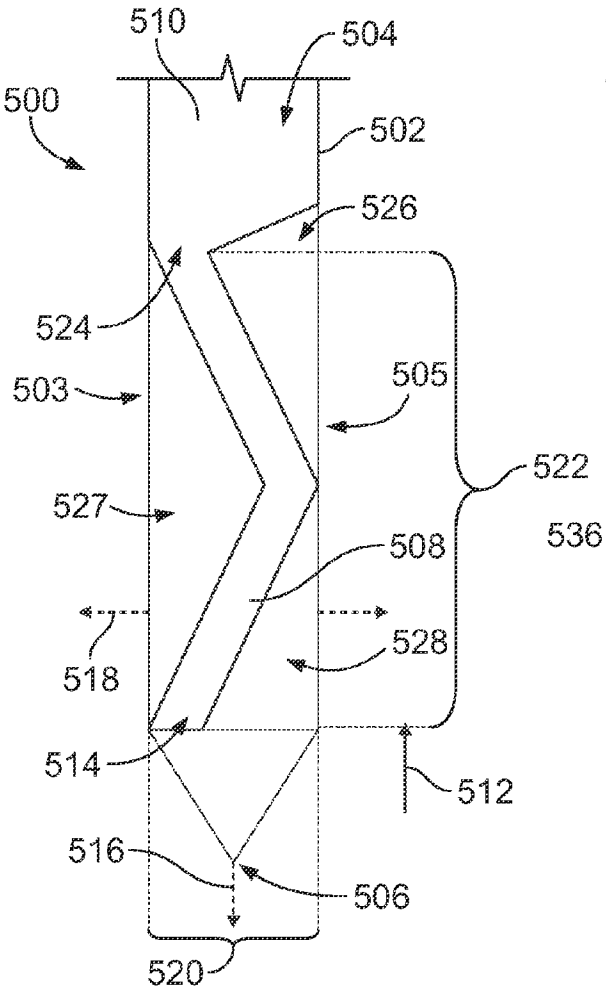
FIG. 11 is a plan view of a portion of a header contact formed in accordance with an embodiment.

FIGS. 11-13 illustrate different header contacts having wipe tracks that move laterally along the corresponding body side. FIG. 11 is a plan view of a header contact 500 formed in accordance with an embodiment. The header contact 500 includes an elongated body 502 that may be similar to the elongated body 412 (FIG. 5). Although not shown, the header contact 500 may also include a proximal base and a compliant pin that may be similar to the proximal base 410 (FIG. 5) and the compliant pin 172 (FIG. 4). The elongated body 502 has a body side 504 that extends between opposite body sides 503, 505. The elongated body 502 may also include a body side (not shown) that is opposite the body side 504. The elongated body 502 includes a distal end 506 and is oriented with respect to a longitudinal axis 516 and a lateral axis 518 that is perpendicular to the longitudinal axis 516.

The body side 504 is shaped to include a wipe track 508 and a contact zone 510. Similar to the wipe track 432 (FIG. 5), the wipe track 508 may be non-linear such that, as the wipe track 508 moves from the distal end 506 to the contact zone 510, the wipe track 508 shifts laterally between the body sides 503, 505. For example, in the illustrated embodiment, the wipe track 508 is adjacent to the body side 503 at a beginning 514 of the wipe track 508. The wipe track 508 extends in a direction that is not parallel with respect to the longitudinal axis 516. About halfway through the wipe track 508, the wipe track 508 may be adjacent to the body side 505. At this point, the wipe track 508 turns such that the wipe track 508 is directed toward the body side 503 as the wipe track 508 heads toward contact zone 510. The wipe track 508 is adjacent to the body side 503 when the wipe track 508 couples to the contact zone 510. As such, the wipe track 508 has a non-linear path that moves partially in two different lateral directions.

Embodiments set forth herein may be configured such that the mating interface of the corresponding contact finger, such as the mating interface 312 (FIG. 4), may engage only a portion of a total possible area of the body side of the elongated body. For example, as shown, the body side 504 has a body width 520 and a segment length 522 that extends from the beginning 514 of the wipe track 508 to an end 524 of the wipe track 508. The wipe track 508 couples to the contact zone 510 at the end 524. The segment length 522 and the body width 520 may define a profile of a portion of the elongated body 502 that includes the wipe track 508. As shown, the profile also includes recessed portions 526, 527, 528. During a mating operation, the mating interface (not shown) directly engages and wipes along the wipe track 508, but moves over the recessed portions 526-528. Thus, the mating interface only engages a portion of the total possible area of the body side 505. By way of example, the mating interface may engage, at most, 60% of the total possible area. In some embodiments, the mating interface may engage, at most, 50% of the total possible area. In known connector systems, the mating interface may engage nearly all of the total possible area.

FIG. 12 illustrates a header contact 530 having a non-linear wipe track 532 that includes multiple parallel track segments 534, 536. As shown, the parallel track segments 534, 536 extend parallel to each other for a designated distance and then join each other at an intersection 538. The wipe track 532 includes a single track segment 539 that extends from the intersection 538 to a contact zone 535. In such embodiments, the mating interface (not shown) may engage each of the track segments 534, 536 for a designated distance. The mating interface may then slide through the intersection 538 and along the track segment 539. Similar to other embodiments described herein, the header contact 530 may reduce a total accumulation of corrosive matter at the contact zone 535.

FIG. 13 illustrates a header contact 540 having an elongated body 542 that extends along a longitudinal axis 544. The elongated body 542 includes a body side 548 having a wipe track 546 and recessed portions 552, 554 that define the wipe track 546. When a mating interface (not shown) engages the wipe track 546, the mating interface may wipe along the wipe track 546 in a mating direction 556 and move over the recessed portions 552, 554. In the illustrated embodiment, the wipe track 546 is substantially linear. However, the wipe track 546 does not extend parallel to the longitudinal axis 544 and/or the mating direction 556. Instead, the wipe track 546 extends partially in the mating direction 556 and partially in a lateral direction 557. The wipe track 546 may be characterized as being skew with respect to the longitudinal axis 544.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing configured to engage a mating connector during a mating operation; and a contact array including electrical contacts that are coupled to the connector housing, each of the electrical contacts including a proximal base coupled to the connector housing and an elongated body that extends from the proximal base to a distal end, wherein the elongated body has a longitudinal axis extending between the proximal base and the distal end and a lateral axis that is perpendicular to the longitudinal axis, the elongated body including a body side that extends along the longitudinal and lateral axes and is shaped to form a wipe track and a contact zone that is adjacent to an end of the wipe track, the wipe track configured to engage a contact finger of the mating connector as the contact finger moves linearly along the longitudinal axis toward the contact zone, the contact zone being configured to directly engage the contact finger during operation of the electrical connector, wherein the body side includes first and second recessed portions that are separated by the wipe track, the wipe track having a non-linear path such that the wipe track turns at least partially in a lateral direction along the lateral axis as the wipe track moves toward the contact zone along the longitudinal axis, the wipe track and the contact zone being portions of a common exterior surface of the elongated body;

wherein the body side is a first body side, the elongated body further comprising a second body side that extends along the longitudinal axis, the first and second body sides facing in generally perpendicular directions, the first recessed portion being defined by a planar surface that extends between and joins the wipe track and the second body side;

wherein the wipe track is a planar surface that is laterally defined between and includes first and second track edges, wherein the elongated body further comprises a third body side, the first body side extending along the lateral axis between the second and third body sides, the first and second track edges extending substantially parallel to the longitudinal axis along the first body side, wherein the elongated body has a body width that extends along the lateral axis between the second and third body sides and the wipe track has a track width that extends along the lateral axis between the two track edges, the track width being less than the body width for a majority of the wipe track.

2. The electrical connector of claim 1, wherein the contact zone has a width that is greater than the track width proximate to the end of the wipe track.

3. The electrical connector of claim 1, wherein the track width is less than or equal to about half the body width for a majority of the wipe track.

4. The electrical connector of claim 1, wherein a first track segment of the wipe track extends adjacent to the second body side, the first recessed portion being between the first track segment and the second body side, and a third track segment of the wipe track extends adjacent to the third body side, the second recessed portion being between the third track segment and the third body side, the first and third track segments being joined by a second track segment of the wipe track that extends at least partially along the lateral axis.

5. The electrical connector of claim 1, wherein the elongated body is a stamped elongated body that includes the contact zone, the first and second recessed portions, the wipe track, and the distal end, the second and third body sides being stamped body sides.

6. The electrical connector of claim 1, wherein the wipe track is devoid of surface discontinuities from a point proximate to the distal end to the contact zone such that the wipe track continuously engages the contact finger from the point proximate to the distal end to the contact zone.

7. An electrical connector comprising:

a connector housing configured to engage a mating connector during a mating operation; and a contact array including electrical contacts coupled to the connector housing, each of the electrical contacts including a proximal base coupled to the connector housing and an elongated body extending from the proximal base to a distal end, wherein the elongated body has a longitudinal axis that extends between the distal end and the proximal base and a lateral axis that is perpendicular to the longitudinal axis, the elongated body also having opposite first and second body sides, each of the first and second body sides extending along the longitudinal axis and being shaped to form a respective wipe track and a respective contact zone that is adjacent to the respective wipe track, the respective wipe track configured to engage a corresponding contact finger of the mating connector as the corresponding contact finger moves linearly along the longitudinal axis toward the respective contact zone, the respective contact zone configured to directly engage the corresponding contact finger during operation of the electrical connector;

wherein each of the first and second body sides includes first and second recessed portions that are separated by the respective wipe track, the respective wipe track having a path in which at least a portion of the path is non-parallel with respect to the longitudinal axis, the respective wipe track and the respective contact zone being portions of a common exterior surface of the elongated body, the respective wipe track being a planar surface that is laterally defined between and includes first and second track edges, the first and second recessed portions being defined by corresponding planar surfaces that join the planar surface of the wipe track along the first and second track edges, respectively, the planar surfaces of the first and second recessed portions being outwardly-facing surfaces that define respective portions of an exterior of the elongated body, wherein the entire wipe track and the contact zone coincide with a contact plane that extends parallel to the longitudinal and lateral axes, wherein the contact planes associated with the first and second body sides being parallel to one another.

8. The electrical connector of claim 7, wherein the path of the wipe track is non-linear.

9. The electrical connector of claim 7, wherein the first and second recessed portions and the wipe track are configured such that the contact finger wipes over the first and second recessed portions as the contact finger engages the wipe track.

10. An electrical contact comprising a proximal base and an elongated body that extends from the proximal base to a distal end, wherein the elongated body has a longitudinal axis extending between the proximal base and the distal end and a lateral axis that is perpendicular to the longitudinal axis, the elongated body including a body side that extends along the longitudinal and lateral axes and is shaped to form a wipe track and a contact zone that is adjacent to an end of the wipe track, the wipe track configured to engage a contact finger of a mating connector as the contact finger moves linearly along the longitudinal axis toward the contact zone, the contact zone configured to directly engage the contact finger during operation of the electrical contact;

wherein the body side is a first body side, the elongated body further comprising a second body side and a third body side that face in generally opposite directions, the first body side extending between the second and third body sides, the elongated body further comprising a first recessed portion that is defined by a corresponding recessed surface that extends between and joins the wipe track and the second body side, the elongated body further comprising a second recessed portion that is defined by a corresponding recessed surface that extends between and joins the wipe track and the third body side; and wherein the wipe track is a planar surface that is laterally defined between and includes first and second track edges, the first and second recessed portions being defined by corresponding planar surfaces that join the planar surface of the wipe track along the first and second track edges, respectively, the planar surfaces of the first and second recessed portions being outwardly-facing surfaces that define respective portions of an exterior of the elongated body, the wipe track having a non-linear path such that the wipe track turns at least partially in a lateral direction along the lateral axis as the wipe track moves toward the contact zone along the longitudinal axis, wherein the entire wipe track and the contact zone coincide with a contact plane that extends parallel to the longitudinal and lateral axes.

11. The electrical contact of claim 10, wherein the elongated body is a stamped elongated body that includes the contact zone, the first and second recessed portions, the wipe track, and the distal end, the corresponding recessed surfaces that define the first and second recessed portions being stamped surfaces.

12. The electrical contact of claim 10, wherein the elongated body includes first and second cross-sections that are taken parallel to the lateral axis and perpendicular to the longitudinal axis at different locations along the longitudinal axis, the first cross-section including the first recessed portion, the second cross-section including the second recessed portion, but not the first recessed portion.

13. The electrical contact of claim 10, wherein the wipe track is devoid of surface discontinuities from a point proximate to the distal end to the contact zone such that the wipe track continuously engages the contact finger from the point proximate to the distal end to the contact zone.

* * * * *